US005722877A

United States Patent [19]

Meyer et al.

[11] Patent Number: 5,722,877

[45] Date of Patent: Mar. 3, 1998

[54] TECHNIQUE FOR IMPROVING WITHIN-WAFER NON-UNIFORMITY OF MATERIAL REMOVAL FOR PERFORMING CMP

[75] Inventors: Anthony S. Meyer, San Jose; Thomas G. Mallon; Bradley Withers, both of Santa Clara; Douglas W. Young, Sunnyvale, all of Calif.

[73] Assignee: Lam Research Corporation, Fremont, Calif.

[21] Appl. No.: 729,614

[22] Filed: Oct. 11, 1996

[51] Int. Cl.[6] ..... B24B 21/00

[52] U.S. Cl. ..... 451/41; 451/59; 451/303; 451/307

[58] Field of Search ..... 451/41, 59, 296, 451/299, 300, 303, 306, 307, 490, 513

[56] References Cited

U.S. PATENT DOCUMENTS

| | | | |
|---|---|---|---|
| 3,753,269 | 8/1973 | Budman | 15/160 |
| 5,232,875 | 8/1993 | Tuttle et al. | 437/225 |
| 5,276,999 | 1/1994 | Bando | 51/62 |
| 5,297,361 | 3/1994 | Baldy et al. | 51/119 |
| 5,329,732 | 7/1994 | Karlsrud et al. | 51/131.5 |
| 5,558,568 | 9/1996 | Talieh et al. | 451/303 |
| 5,575,707 | 11/1996 | Talieh et al. | 451/307 |

FOREIGN PATENT DOCUMENTS 2-269553 2/1990 Japan .

*Primary Examiner*—Eileen P. Morgan
*Attorney, Agent, or Firm*—Kidd & Booth

[57] ABSTRACT

A platen ring for use with a platen on a linear polisher, in which the platen ring is used to reduce fluctuation of the belt/pad assembly as it encounters the platen. The platen ring is disposed around the platen so that a fluctuation of the belt/pad assembly is dampened before the belt/pad assembly engages the platen. Reduction of the belt/pad fluctuation ensures a reduction in the within-wafer non-uniformity and provides for a more uniform polishing rate across the surface of the wafer.

28 Claims, 7 Drawing Sheets

TECHNIQUE FOR IMPROVING WITHIN-WAFER NON-UNIFORMITY OF MATERIAL REMOVAL FOR PERFORMING CMP

BACKGROUND OF THE INVENTION

1. Field of the Invention

The present invention relates to the field of semiconductor wafer processing and, more particularly, to chemical-mechanical polishing of semiconductor wafers.

2. Background of the Related Art

The manufacture of an integrated circuit device requires the formation of various layers (both conductive and non-conductive) above a base substrate to form the necessary components and interconnects. During the manufacturing process, removal of a certain layer or portions of a layer must be achieved in order to pattern and form various components and interconnects. Chemical mechanical polishing (CMP) is being extensively pursued to planarize a surface of a semiconductor wafer, such as a silicon wafer, at various stages of integrated circuit processing. It is also used in flattening optical surfaces, metrology samples, and various metal and semiconductor based substrates.

CMP is a technique in which a chemical slurry is used along with a polishing pad to polish away materials on a semiconductor wafer. The mechanical movement of the pad relative to the wafer in combination with the chemical reaction of the slurry disposed between the wafer and the pad, provide the abrasive force with chemical erosion to polish the exposed surface of the wafer (or a layer formed on the wafer), when subjected to a force pressing the wafer onto the pad. In the most common method of performing CMP, a wafer (or whatever material that is to be polished) is mounted on a polishing head which rotates against a polishing pad placed on a rotating table (see, for example, U.S. Pat. No. 5,329,732). The mechanical force for polishing is derived from the rotating table speed and the downward force on the head. The chemical slurry is constantly transferred under the polishing head and the rotation of the wafer helps in the slurry delivery, as well as in averaging the polishing rates across the wafer surface.

One technique for obtaining a more uniform polishing rate is to utilize a linear polisher. Instead of a rotating pad, a moving belt is used to linearly move the pad across the wafer surface. The wafer is still rotated for averaging out the local variations, but the global planarity is improved over CMP tools using rotating pads. One such example of a linear polisher is described in a patent application titled "Linear Polisher And Method For Semiconductor Wafer Planarization;" Ser. No. 08/287,658; filed Aug. 9, 1994.

Unlike the hardened table top of a rotating polisher, linear polishers are capable of using flexible belts, upon which the pad is disposed. This flexibility allows the belt to flex and change the pad pressure being exerted on the wafer. In some instances additional flexibility is introduced by a fluid platen. One such fluid platen is described in a patent application titled "Control Of Chemical-Mechanical Polishing Rate Across A Substrate Surface For A Linear Polisher;" Ser. No. 08/638,462; filed Apr. 26, 1996. Although the flexible belt allows additional polishing controls to be exerted, such as by the fluid platen, the flexibility of the belt also adds certain new concerns or problems not typically encountered with the hardened table rotating polisher.

A significant problem associated with the belt/pad assembly is the introduction of polishing rate variations between the periphery and interior regions of the wafer being polished. It is desirable for the belt (and the pad disposed on the belt) to be sufficiently flat (planar) as it travels linearly across the wafer surface. However in practice, as the belt encounters the platen/wafer assembly during its travel, it has a tendency to bounce or compress, causing the belt to not be sufficiently flat. This variation of the belt/pad assembly at the leading edge, where it first encounters the platen/wafer assembly, causes the periphery (edge) of the wafer to be polished at a different rate from the interior region. This polishing variation at the edge of the wafer leads to within-wafer non-uniformity.

The present invention describes a novel technique for improving the within-wafer non-uniformity so that the edge region of the wafer will be polished at the same rate as the interior region.

SUMMARY OF THE INVENTION

The present invention describes a platen ring for use with a platen on a linear polisher, in which the platen ring is used to reduce fluctuations of a belt/pad assembly as it encounters the platen. The platen ring is disposed so that the linearly traveling belt/pad assembly encounters the ring before it encounters the platen or a wafer disposed above the belt/pad assembly. The presence of the ring at an edge boundary causes belt/pad assembly fluctuations to be dampened before that portion of the belt encounters the platen/wafer assembly. Thus, the platen ring operates as a damper to dampen belt/pad fluctuations.

By ensuring the belt/pad assembly fluctuations to be reduced before the fluctuations encounter the wafer, belt/pad planarity is for the portion of the belt/pad assembly engaging the wafer. Since belt/pad fluctuations at the edge of the wafer can cause polishing rates to differ between the edge region and the interior region of the wafer, the reduction of the belt/pad fluctuation will bring the polishing rates of the two regions closer together. By having a more uniform polishing rate across the whole of the wafer surface, within-wafer non-uniformity is reduced.

DETAILED DESCRIPTION OF THE PREFERRED EMBODIMENTS

A method and apparatus for obtaining a more uniform polishing rate across a substrate during chemical-mechanical polishing (CMP) using a linear polisher in order to achieve an improved within-wafer non-uniformity is described. In the following description, numerous specific details are set forth, such as specific structures, materials, polishing techniques, etc., in order to provide a thorough understanding of the present invention. However, it will be appreciated by one skilled in the art that the present invention may be practiced without these specific details. In other instances, well known techniques and structures have not been described in detail in order not to obscure the present invention. The present invention is described in reference to performing CMP on a semiconductor wafer, but the invention can be readily adapted to polish other materials as well.

Figure 1:
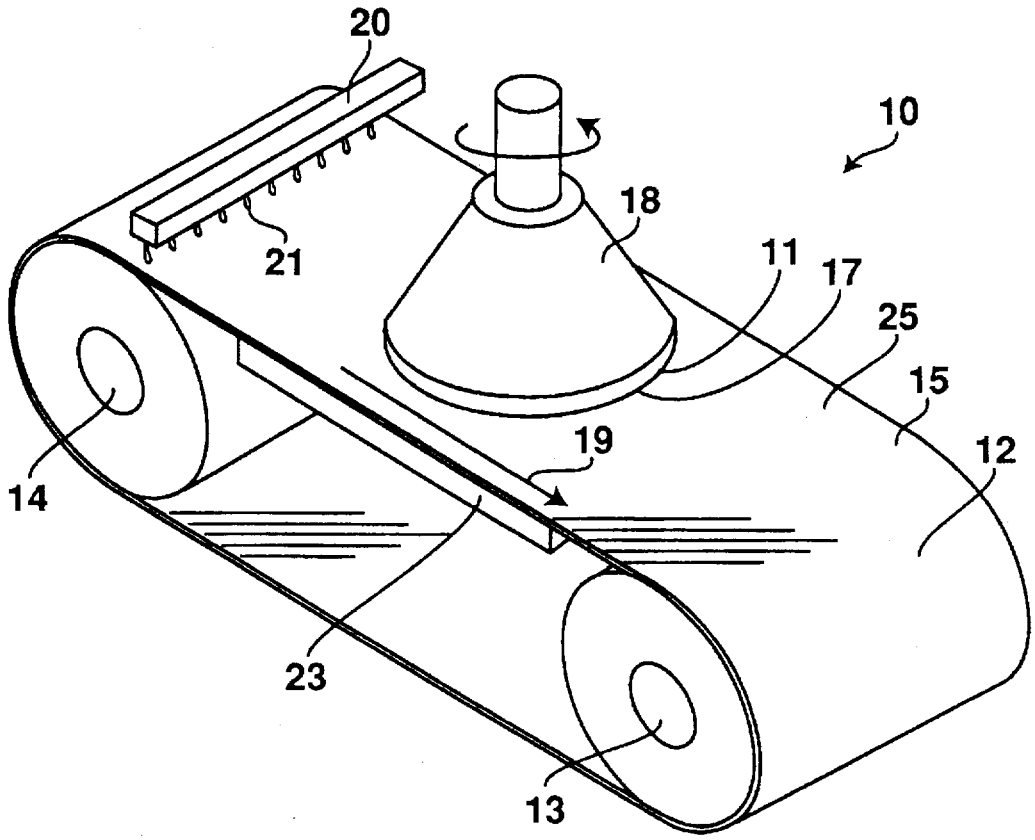
FIG. 1 (Prior Art)
FIG. 1 is a pictorial illustration of a prior art linear polisher.
Figure 2:
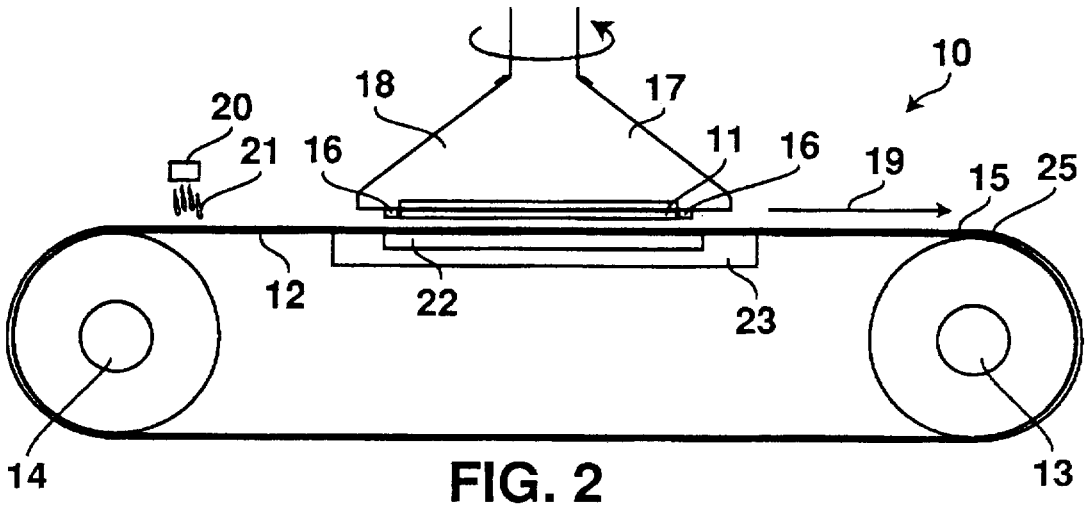
FIG. 2 (Prior Art)
FIG. 2 is a cross-sectional diagram of the linear polisher of FIG. 1.

Referring to FIGS. 1 and 2, a linear polisher 10 for use in practicing the present invention is shown. The linear polisher 10 is utilized in polishing a semiconductor wafer 11, such as a silicon wafer, to polish away materials on the surface of the wafer. The material being removed can be the substrate material of the wafer itself or one of the layers formed on the substrate. Such formed layers include dielectric materials (such as silicon dioxide), metals (such as aluminum, copper or tungsten), metal alloys or semiconductor materials (such as silicon or polysilicon). More specifically, a polishing technique generally known in the art as chemical-mechanical polishing (CMP) is employed to polish one or more of these layers fabricated on the wafer 11, in order to planarize the surface layer. Generally, the art of performing CMP to polish away layers on a wafer is known and prevalent practice has been to perform CMP by subjecting the surface of the wafer to a rotating platform (or platen) containing a pad (see for example, the Background section above). An example of such a device is illustrated in the afore-mentioned U.S. Pat. No. 5,329,732.

The linear polisher 10 is unlike the rotating pad device in current practice. The linear polisher 10 utilizes a belt 12, which moves linearly in respect to the surface of the wafer 11. The belt 12 is a continuous belt rotating about rollers (or spindles) 13 and 14, which rollers are driven by a driving means, such as a motor, so that the rotational motion of the rollers 13–14 causes the belt 12 to be driven in a linear motion with respect to the wafer 11, as shown by arrow 19. A polishing pad 15 is affixed onto the belt 12 at its outer surface facing the wafer 11 (and is herein referenced as the belt/pad assembly 25). Thus, the pad 15 is made to move linearly relative to the wafer 11 as a single assembled unit with belt 12, as the belt 12 is driven linearly.

The wafer 11 is made to reside within a wafer carrier 17, which is part of housing 18. The wafer 11 is held in position by a mechanical retaining means, such as a retainer ring 16. A primary purpose of the retainer ring 16 is to retain the wafer in the carrier 17 so that the wafer will not move horizontally as the belt/pad assembly 25 is driven linearly (horizontally) across the surface of the wafer. Typically, the carrier 17 is rotated in order to rotate the wafer 11. The rotation of the wafer 11 allows for averaging of the polishing contact of the wafer surface with the pad 15.

Furthermore, for the linear polisher 10, there is a slurry dispensing mechanism 20, which dispenses a slurry 21 onto pad 15. The slurry 21 is necessary for proper CMP of the wafer 11. A pad conditioner (not shown in the drawings) is typically used in order to recondition the pad during use. Techniques for reconditioning the pad during use are known in the art and generally require a constant scratching of the pad in order to remove the residue build-up caused by the used slurry and removed waste material. One of a variety of pad conditioning or pad cleaning devices can be readily adapted for use with linear polisher 10.

The linear polisher 10 also includes a platen 22 disposed on the underside of belt 12 and opposite from carrier 17, such that the belt/pad assembly 25 resides between platen 22 and wafer 11. The platen 22 is typically mounted in (or on) or is part of a support housing 23, positioned to provide support for platen 22. A primary purpose of platen 22 is to provide a supporting platform on the underside of the belt 12 to ensure that the pad 15 makes sufficient contact with the wafer 11 for uniform polishing. Typically, the carrier 17 is pressed downward against the belt 12 and pad 15 with appropriate force, so that the wafer 11 makes sufficient contact with pad 15 for performing CMP. Since the belt/pad assembly 25 is flexible and will depress when the wafer is pressed downward onto the pad 15, platen 22 provides a necessary counteracting force to this downward force.

Although platen 22 can be of a solid platform, a preference is to have platen 22 function as a type of fluid bearing for the linear polisher 10. Examples of fluid bearings/platens are described in patent applications titled "Wafer Polishing Machine With Fluid Bearings;" Ser.l No. 08/333,463; filed Nov. 2, 1994; "Control Of Chemical-Mechanical Polishing Rate Across A Substrate Surface For A Linear Polisher;" Ser. No. 08/638,462; filed Apr. 26, 1996 and "Control 0f Chemical-Mechanical Polishing Rate Across A Substrate Surface;" Ser. No. 08/638,464; filed Apr. 26, 1996.

These pending applications describe fluid bearings/platens having pressurized fluid directed against the underside of the belt 12. By use of such fluid bearings/platens, the fluid pressure adjustments are performed to provide some compensation for non-uniform polishing of the wafer. It is appreciated that a desired result is to obtain a uniform polishing rate across the surface of the layer when CMP is performed, in order to obtain the most uniform planarized layer possible. Variations in the polishing rate will cause within-wafer non-uniformity, which can result in unacceptable planarity or unacceptable final thickness of the layer being polished.

Figure 3A:
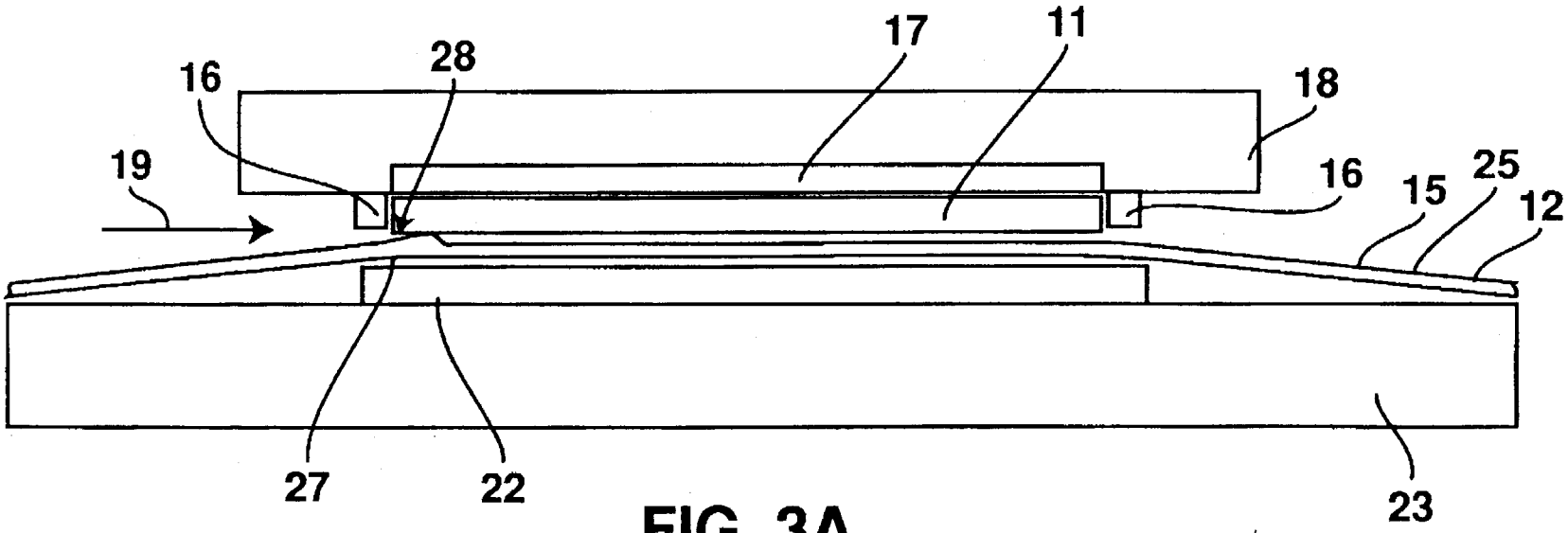
FIG. 3A (Prior Art)
FIG. 3A is an enlarged cross-sectional view of the linear polisher of FIG. 1 showing a belt/pad fluctuation as the belt/pad assembly encounters a platen disposed under the belt and a wafer disposed above the belt.
Figure 3B:
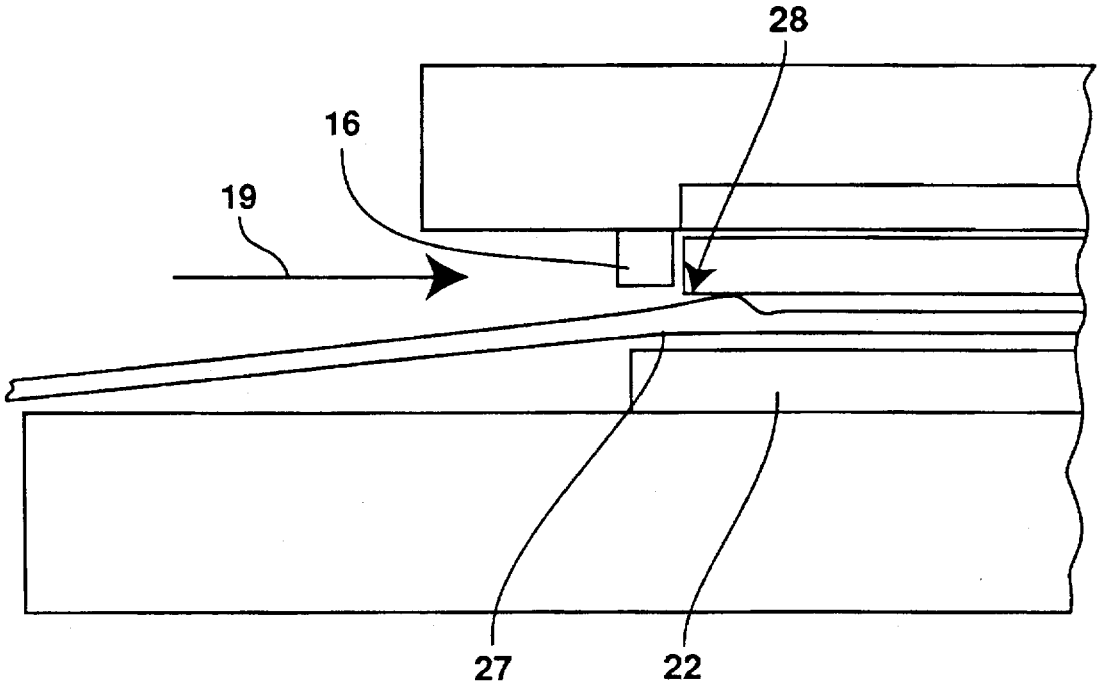
FIG. 3B (Prior Art)
FIG. 3B is a further enlarged cross-sectional view showing a portion of FIG. 3A where the belt/pad assembly encounters the wafer and the platen.

Referring to FIGS. 3A and 3B (hereinafter collectively referred to as FIG. 3), it illustrates a problem associated with the use of the linear polisher 10. Even with the use of a fluid platen to adjust for polishing uniformity, the edge areas are still considerably difficult to control. That is, the wafer edge region polishes at a different rate as compared to the interior region of the wafer. It is believed that a cause for this difference in polishing rate between the edge region and the interior region of the wafer is due to belt/pad fluctuation at an edge boundary 27 where the belt/pad assembly 25 engages the wafer/platen assembly during its travel. It is also believed that the leading edge boundary (where a point on the belt/pad assembly first engages the wafer/platen) has a more significant fluctuation than at the trailing edge portion of the belt/pad assembly (where a point on the belt/pad assembly disengages the wafer/platen).

In general practice, the diameter of the platen is slightly larger than that of the wafer, so that the platen extends 0.25 inch past the end of the wafer 11. Thus, the belt/pad assembly 25 typically engages the platen 22 prior to engaging the wafer 11 and disengages the platen 22 after disengaging the wafer 11. The belt/pad assembly 25 has a tendency to bounce or compress due to a slight decrease in its velocity at the point of engagement at the leading edge boundary 27 and a lesser effect at the trailing edge. As shown in FIG. 3 (in exaggeration), a compression wave 28 is shown forming at the leading edge boundary so that the belt/pad assembly 25 is not flat (or planar) at this location.

Additionally, fluctuations of the belt/pad assembly 25 at the wafer's edge is also attributed to the positioning of the belt/pad assembly 25 relative to the plane of the wafer. If the belt/pad assembly 25 is not level with the wafer/platen surface, the belt/pad assembly 25 will enter (and/or exit) the wafer's edge at an angle from the horizontal. In FIG. 3, the belt/pad assembly 25 is shown angled slightly as it approaches the plane of the platen surface from below. When this occurs, the very edge of the wafer receives slower polishing and the region just inside the wafer edge receives faster polishing. Thus, fluctuations at the edge of the wafer can also be caused by improper positioning of the belt/pad assembly 25 during polishing.

In any event, understanding what actually occurs at the wafer's edge boundary (both leading and trailing) is important, but not as critical as the effect it has on the polishing rate at the boundary. That is, in the linear polisher 10, some amount of polishing rate variation is experienced at the wafer's edge region, where a point on the belt/pad assembly 25 engages the wafer surface and/or exits the wafer surface. Because of the fluctuation of the belt/pad assembly 25, polishing rate variations can and do occur along the wafer's edge as compared to the interior region of the wafer.

Figure 4:
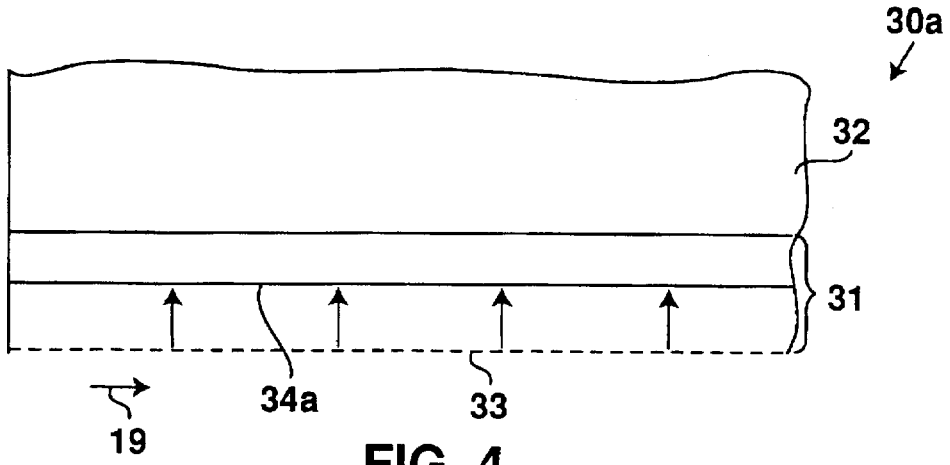
FIG. 4 shows a cross-sectional view of a wafer having a layer formed thereon and in which the layer is polished at an ideal uniform rate across the whole surface of the wafer.

In FIG. 4, an ideal polishing situation is illustrated for wafer 30*a*. The wafer 30*a* has a layer 31, which is to be polished by CMP, formed on an underlying layer 32. The layer 32 can be a formed layer or it can be the wafer substrate itself. The original thickness of the layer 31 is denoted by dotted line 33. When the layer 31 is ideally polished so that it has ideal uniformity, it is polished back to form layer 34*a*. The uniform planarization of layer 31 results in a planarized and substantially flat layer 34*a*. A uniformity ratio of the thickness at the edge to the thickness near the center for layer 34*a* would result in a value of 1.0 for the ideal condition.

Figure 5:
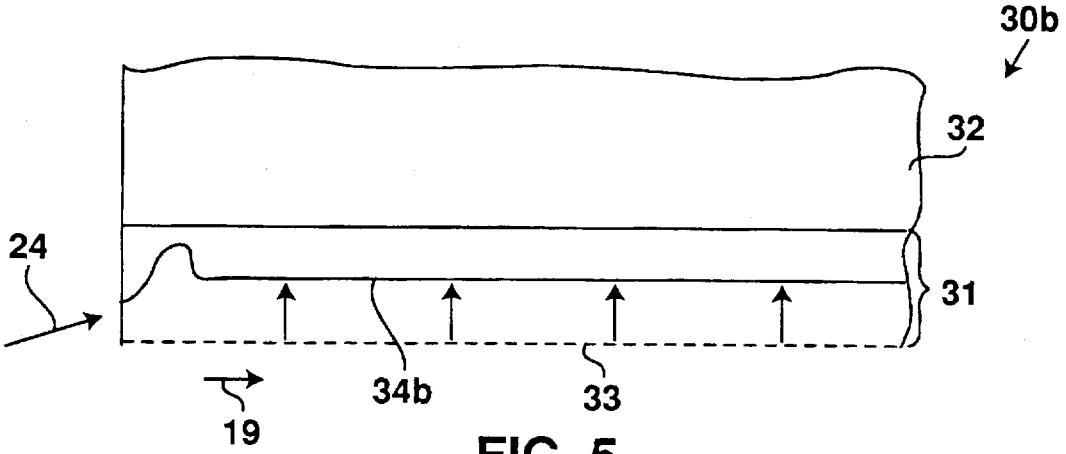
FIG. 5 shows a cross-sectional view of a wafer having the layer of FIG. 4 formed thereon, but in which a non-uniform polishing profile has been formed as a result of slower polishing at the very edge of the wafer, then faster polishing just inside the edge of the wafer, and then even polishing over the remainder of the interior of the wafer.
Figure 6:
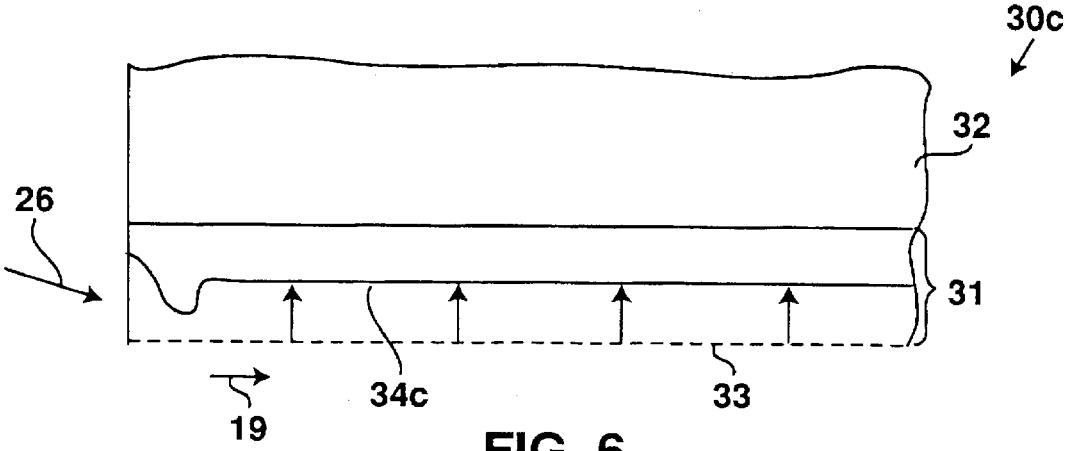
FIG. 6 shows a cross-sectional view of a wafer having the layer of FIG. 4 formed thereon, but in which a non-uniform polishing profile has been formed as a result of faster polishing at the very edge of the wafer, then slower polishing just inside the edge of the wafer, and then even polishing over the remainder of the interior of the wafer.

However in actual practice, when the linear polisher 10 is utilized to perform CMP on layer 33, the results are more akin to the exemplary illustrations of FIGS. 5 and 6. In FIG. 5, wafer 30*b* is polished in which the polishing rate at the edge is non-uniform. At the immediate edge, less material from layer 31 is removed, but is then followed by more material removal, as compared to the interior region of layer 31. Thus, after polishing, the wafer will show a thicker layer at the immediate edge of the wafer, while just inside of the immediate wafer edge, the layer will be thinner. Toward the interior of the wafer, the layer thickness will even out again. The compression wave at the edge of the wafer can cause the polishing profile shown in FIG. 5 to occur. Also, if the belt/pad assembly 25 enters (or exits) the wafer boundary at a slightly downward angle (towards the platen, as shown by arrow 24), it can cause the polishing profile shown in FIG. 5. Accordingly, layer 31 is polished to form layer 34*b*, in which the uniformity ratio would be greater than 1.

Conversely, in FIG. 6, wafer 30*c* is polished in which the polishing rate profile is opposite that shown in FIG. 5. At the immediate edge, more material from layer 31 is removed, but is then followed by less material removal, as compared to the interior region of layer 31. Thus, after polishing, the wafer will show a thinner layer at the immediate edge of the wafer, while just inside of the immediate wafer edge, the layer will be thicker. Toward the interior of the wafer, the layer thickness will even out again. Again, depending on the profile of the compression wave at the edge of the wafer, it can cause the polishing profile shown in FIG. 6 to occur. Also, if the belt/pad assembly 25 enters (or exits) the wafer boundary at a slightly upward angle (towards the wafer, as shown by arrow 26), it can cause the polishing profile shown in FIG. 6. Accordingly, layer 31 is polished to form layer 34*c*, in which the uniformity ratio would be less than 1.0.

Since the polishing rate across the layer 31 varies and heightens the within-wafer non-uniformity value, the variation is undesirable and could be unacceptable for some processes. It is appreciated that the polishing rate variations between the edge and the interior of the wafer can be attributed, at least partly, to the belt/pad fluctuations due to belt/pad compression at the wafer boundary and this fluctuation can be heightened by improper positioning of the belt/pad assembly 25 relative to the wafer/platen.

Figure 7:
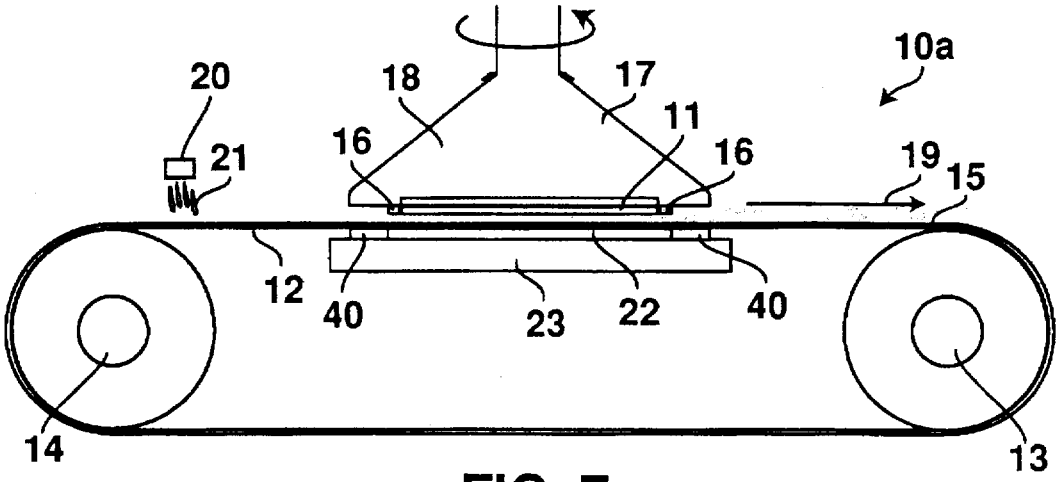
FIG. 7 is a cross-sectional view of a linear polisher in which a platen ring of the present invention is employed around the platen to improve upon the polishing uniformity at the edge region of the wafer.
Figure 8:
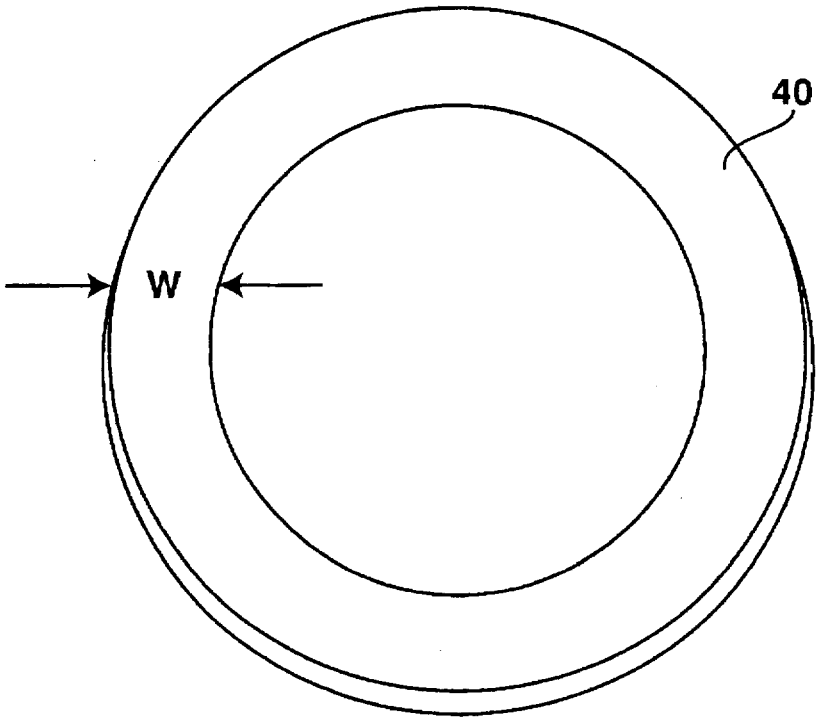
FIG. 8 is a pictorial view of the platen ring of the present invention.

Referring to FIG. 7, the linear polisher 10*a* equipped with a fluctuation damper, in the form of a dampening ring (hereinafter referred to as a platen ring 40), of the present invention is shown. The linear polisher 10*a* is equivalent to polisher 10 of FIGS. 1 and 2, but it now has the platen ring 40 mounted on the support housing 23. The platen ring 40, which is shown in enlarged detail in FIG. 8, is used to improve the within-wafer non-uniformity of material removal. The platen ring 40 is an annular ring made to fit around the platen 22. The platen ring 40 can be made from a variety of materials, including metal and plastic, provided it is adequately hard so as not to compress when subjected to the movement of the belt. The platen ring is affixed to the support housing 23 by adhesive tape, screws, clamps, locks or other equivalent fastening means. The physical dimensions of the platen ring 40 are described below, since these dimensions are important to the proper operation of the linear polisher 10*a*.

Figure 9:
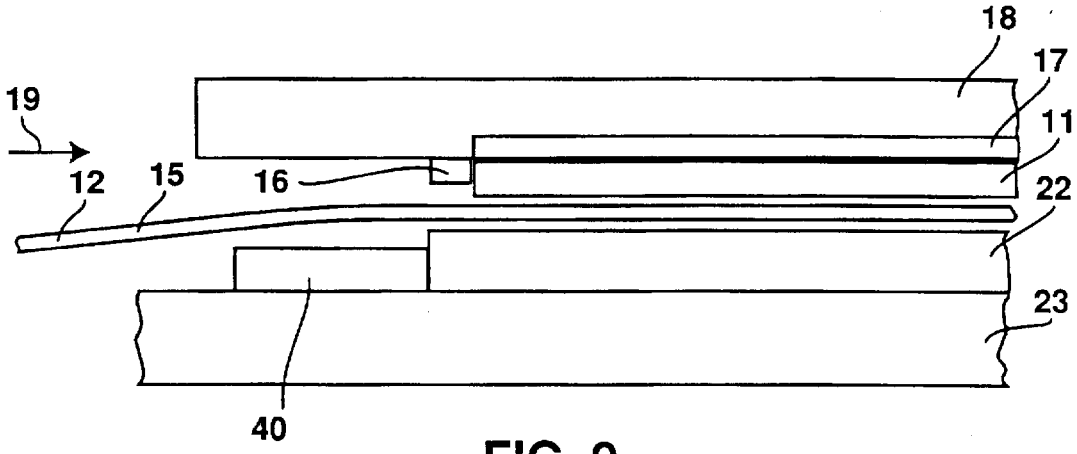
FIG. 9 is an enlarged cross-sectional view of the polisher of FIG. 7 implementing the platen ring of the present invention in order to reduce belt/pad fluctuation as the belt/pad assembly travels across the wafer surface.

Referring to FIG. 9, it shows an enlarged cross-sectional view of the wafer/platen assembly with the belt/pad assembly 25 disposed there between. The platen ring 40 circumscribes the platen 22, so that the linearly moving belt/pad assembly 25 encounters the platen ring 40 before it engages the platen 22 or the wafer 11. That is, the belt/pad assembly 25 will engage (or make physical contact) with the upper surface of the platen ring 40 as it travels linearly in direction 19. The belt/pad assembly 25 bouncing and compression, which was previously encountered at the edge of the wafer/platen assembly, is now compensated by the platen ring 40. By the time the portion of the belt/pad assembly 25 reaches the edge of the wafer 11, the belt/pad assembly's linearity is restored to that of a substantially flat belt. Accordingly, since the edge of the wafer no longer is subjected to the belt/pad fluctuation, the rate of polish (and hence, the polishing profile) at the edge of the wafer is much more closer to that of the wafer at its interior.

Figure 10:
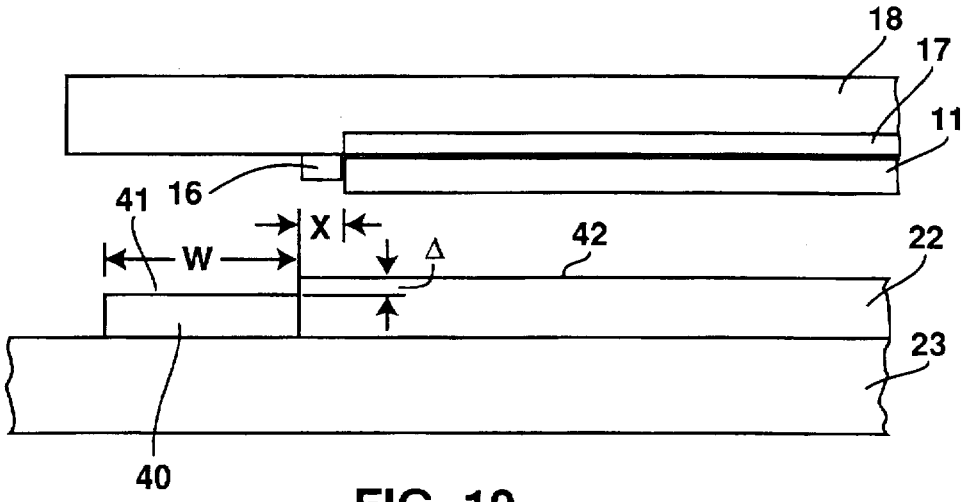
FIG. 10 is an enlarged cross-sectional view of the polisher of FIG. 9 showing (but not showing the belt and pad) dimensions associated with the platen ring of the present invention.

Through experimentation, it has been determined that the dimensions of the platen ring 40 are critical for optimizing the reduction of within-wafer non-uniformity. As shown in FIG. 10, three dimensions are noted in reference to the platen ring 40. Distance "W" denotes the width of platen ring 40, which is the distance platen ring 40 extends outward from platen 22. Distance "X" denotes the distance between the end of the wafer to the end of platen 22. Distance "Δ" denotes the difference in height between the upper surfaces of platen ring 40 and platen 20. A positive Δ denotes that the upper surface of ring 40 is lower than the surface of the platen 22. A negative Δ denotes that the upper surface 41 of the platen ring 40 is higher than the surface 42 of the platen 22.

Again through experimentation, it has been determined that the distance Δ has significant impact on compensating for the belt/pad fluctuation at the edge. If distance Δ is sufficiently negative (that is, the upper surface 41 of the ring 40 is significantly above the surface 42 of the platen 22), the polishing profile shown in FIG. 6 occurs. This is equivalent to the result of having the belt/pad assembly 25 approach the edge of the wafer from an upward angle. The added height of the platen ring 40 essentially causes the belt/pad assembly 25 to behave as though it is misaligned and entering from an upward angle (from the direction of the wafer).

Conversely, if distance Δ is sufficiently positive (that is, the upper surface 41 of the ring 40 is significantly below the surface 42 of the platen 22), the polishing profile shown in FIG. 5 occurs. This is equivalent to the result of having the belt/pad assembly 25 approach the edge of the wafer from a downward angle. The reduced height of the platen ring 40 essentially causes the belt/pad assembly 25 to behave as though it is misaligned and entering from an downward angle (from the direction of the platen). Accordingly, in order to obtain a condition more closely resembling the ideal condition shown in FIG. 4, it is desirable that distance Δ be within a certain tolerance bounded by minimum and maximum limits.

Distance W is also important in respect to damping the belt/pad fluctuation as it approaches the platen/wafer assembly. Here distance W must be of sufficient width so that belt/pad variations can be dampened before the belt/pad assembly 25 encounters the wafer/platen assembly. Distance X is the distance between the edge of the wafer 11 and the edge of the platen 22 (difference in the platen and wafer radii). This distance varies from machine to machine, but is generally small for most machines, since the diameter of most platens are designed to match that of the size of the wafer being processed.

One exemplary linear polisher utilizing the present invention for polishing a 200 millimeter (8-inch) wafer has the following dimensions for W, X and Δ. In this exemplary tool, X is approximately 0.25 inch (which is a typical range for sizing platens to wafers), W is approximately 0.25–2.5 inches and Δ is in the range of +0.1 to −0.1 inch. That is, the upper surface of ring 40 is disposed in the approximate range of 0.1 inch above to 0.1 inch below the surface of platen 22 for the particular tool 10*a* described.

It is appreciated that in actual practice, it is preferred to have the Δ distance be in the positive range of 0 to 0.05 inches. That is, the platen ring surface 41 should be at the same level as the surface 42 of platen 22 or up to 0.05 inches below it. With this arrangement, it is preferred to have the belt/pad assembly 25 approach the platen from the horizontal or from a slight downward angle. The slightly sloping angle of the belt/pad assembly 25 will be compensated by the platen ring 40. On the other hand, if the belt/pad assembly 25 enters the edge region from a slightly upward angle, generally less control is obtainable since the platen ring 40 is on the lower surface. However, an additional compensating element for just this condition is described below.

Figure 11:
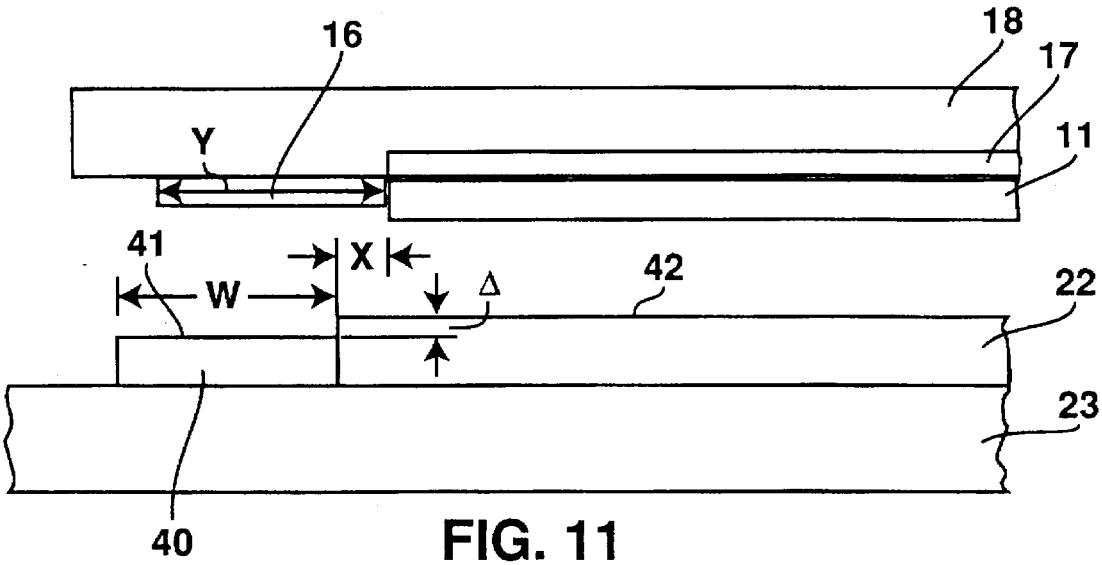
FIG. 11 is an enlarged cross-sectional view of the polisher of FIG. 10 in which an extended wafer retaining ring is also utilized to improve upon the belt/pad fluctuation at the edge region.

Referring to FIG. 11, an alternative embodiment of the present invention is shown in which the platen ring 40 described above is utilized in conjunction with an extended wafer retainer ring 16*a*. Distance Y denotes the width of the retainer ring 16*a* which circumscribes the wafer to prevent it from horizontal movement. Typically this distance Y is in the approximate range of 0.25 inch (such as for retainer ring 16 shown in the earlier Figures). With the alternative embodiment, distance Y is extended to a range of 0.5 inch to the full length of the platen ring 40. The extended retainer ring 16*a* further assists in the reduction of the fluctuations of the belt/pad assembly 25. It also provides improved controls on the fluctuation if the belt/pad angle is such that it approaches from the above (having an upward angle). Accordingly, it is preferred that the polisher have both the platen ring 40 and the extended retainer ring 16*a* in place, in order to reduce the belt/pad fluctuation and compensate for non-horizontal belt/pad entrance (and exit) to the wafer/platen region of the polisher.

Thus, by providing a platen ring around a wafer platen to dampen belt/pad fluctuations, belt/pad linearity is improved so that the edge polishing rate of the wafer can be brought closer to the polishing rate of the interior region of the wafer. This then results in reduced within-wafer non-uniformity. The polishing performance is further improved when the width of the wafer retaining ring (disposed above the belt/pad assembly) is extended outward as well. However, the present invention can be readily practiced to yield improved results simply by the use of the platen ring 40. It is appreciated that the actual dimensions of the platen ring will vary depending on other factors which affect the edge polishing to be different. Those factors include (but are not limited to), downforce on the wafer, belt speed, belt and pad material, thickness of the belt and pad, type of slurry and slurry volume.

Accordingly, different size (W and Δ dimension) platen rings 40 can be manufactured and the proper ring installed for a given system. Also, by having a removable ring, platen rings 40 of different size could be swapped as polishing results start to deteriorate. Variable ring height can be accommodated by having shims or other adjusting means adjust the height of the platen ring 40. Thus, the platen ring 40 can be made variable in height.

Furthermore, although the preferred embodiment is described in respect to a platen ring, primarily since the present invention is designed to accommodate existing platens, the ring itself can be incorporated as part of the platen when the platen is manufactured. However, this will no longer provide the advantages noted above for replacing or swapping rings 40.

Finally, although the preferred embodiment is described in reference to an annular ring which circumscribes the wafer, the ring need not completely surround the wafer. Accordingly, belt fluctuation dampers of other shapes and sizes can be installed at the edge boundaries to reduce (or dampen) the belt fluctuation. However, since control of the trailing edge is also desirable (due to belt/pad fluctuation also occurring at the trailing edge as the result of the belt/pad assembly leaving the platen/wafer area), it is generally preferred that a full ring be utilized.

Thus, a platen ring for reducing within-wafer non-uniformity in a linear polishing tool is described. The tool is generally used for polishing a semiconductor substrate (such as a silicon semiconductor wafer) while performing CMP. However, the polisher could be readily adapted for polishing other materials as well, such as other substrates, including substrates for fabricating flat panel displays. Furthermore, the preferred embodiment is an annular platen ring circumscribing a circular wafer. However, it is appreciated that the shape of the platen ring is a design choice. Thus, the ring can be of configured into a different shape (such as a square or rectangular shape) to accommodate a particular platen. It could also be made to compensate for only the leading edge of the belt/pad travel. In such an instance, half of a ring can be disposed at the leading edge. However, for optimum performance, it is desirable to have a fully circumscribing dampening ring.

We claim:

1. A support housing for supporting a linearly moving belt and a polishing pad disposed on said belt, in which said belt is disposed between said support housing and a surface of a material upon which said polishing pad engages to polish said material comprising:

a platen for having said belt reside thereon and in which a force exerted by said material onto said pad is counteracted by said platen, said platen disposed opposite said material and underlying said belt;

a damper coupled to said platen and disposed along a periphery of said platen where said belt engages said platen, said damper for reducing belt or pad fluctuation where said pad engages said material to obtain a more uniform polishing rate across said surface of said material.

2. The support housing of claim 1 wherein said damper is shaped to fully circumscribe said platen.

3. The support housing of claim 2 wherein said damper is annular in shape.

4. The support housing of claim 3 wherein said damper is disposed at a height within an approximate range of 0.1 inch above and 0.1 inch below a height of said platen upon which said belt engages.

5. A support housing for supporting a linearly moving belt and a polishing pad disposed on said belt, in which said belt is disposed between said support housing and a surface of a semiconductor wafer upon which said polishing pad engages to polish said semiconductor wafer comprising:

a platen for having said belt reside thereon and in which a downward force exerted by said wafer onto said pad is counteracted by said platen, said platen disposed opposite said wafer and underlying said belt;

a damper coupled to said platen and disposed along a periphery of said platen where said belt engages said platen, said damper for reducing belt or pad fluctuation where said pad engages said wafer to obtain a more uniform polishing rate across said surface of said wafer.

6. The support housing of claim 5 wherein said damper is shaped to fully circumscribe said platen.

7. The support housing of claim 6 wherein said damper is annular in shape.

8. The support housing of claim 7 wherein said damper is disposed at a height within an approximate range of 0.1 inch above and 0.1 inch below a height of said platen upon which said belt engages.

9. The support housing of claim 8 wherein said damper is approximately 0.25 to 2.5 inches wide.

10. A linear polisher for performing chemical-mechanical polishing in which a linearly moving belt and a polishing pad disposed on said belt engages a surface of a layer formed on a semiconductor wafer pressed downward onto said pad for polishing said surface comprising:

a platen for having said belt reside thereon and in which a downward force exerted by said wafer onto said pad is counteracted by said platen, said platen disposed opposite said wafer and underlying said belt;

a dampening ring coupled to circumscribe said platen for reducing belt or pad fluctuation where said pad engages said wafer.

11. The linear polisher of claim 10 wherein said dampening ring is disposed at a height within an approximate range of 0.1 inch above and 0.1 inch below a height of said platen upon which said belt engages.

12. The linear polisher of claim 11 wherein said dampening ring is approximately 0.25 to 2.5 inches wide.

13. The linear polisher of claim 10 further including a wafer retainer ring circumscribing said wafer and having sufficient width to further dampen said fluctuations where said pad engages said wafer.

14. The linear polisher of 13 wherein said width of said wafer retaining ring is approximately from 0.5 inches to a width of said dampening ring.

15. A method of polishing a planar surface of a material by engaging said surface against a polishing pad disposed on a linearly moving belt in which said belt is disposed between a support platen and said material, comprising the steps of:

providing a damper disposed along a periphery of said platen where said belt engages said platen, said damper for reducing belt or pad fluctuation where said pad engages said material to obtain a more uniform polishing rate across said surface of said material, said damper also being disposed beyond a periphery of said material;

polishing said material by linearly moving said belt and pad across said surface of said material.

16. The method of claim 15 wherein said damper is shaped to fully circumscribe said platen.

17. The method of claim 16 wherein said damper is annular in shape.

18. The method of claim 17 wherein said damper is disposed at a height within an approximate range of 0.1 inch above and 0.1 inch below a height of said platen upon which said belt engages.

19. The method of claim 18 wherein said damper is approximately 0.25 to 2.5 inches wide.

20. A method of polishing a surface of a semiconductor wafer by engaging said surface against a polishing pad disposed on a linearly moving belt in which said belt is disposed between a support platen and said wafer, comprising the steps of:

providing a dampening ring disposed along a periphery of said platen where said belt engages said platen, said dampening ring for reducing belt or pad fluctuation where said pad engages said wafer to obtain a more uniform polishing rate across said surface of said wafer, said dampening ring being disposed beyond a periphery of said wafer;

polishing said wafer by linearly moving said belt and pad across said surface of said wafer.

21. The method of claim 20 wherein said dampening ring is annular in shape to fully circumscribe said platen.

22. The method of claim 21 wherein said damper is disposed at a height within an approximate range of 0.1 inch above and 0.1 inch below a height of said platen upon which said belt engages.

23. The method of claim 22 wherein said damper is approximately 0.25 to 2.5 inches wide.

24. In a linear polisher for performing chemical-mechanical polishing, a method of polishing a surface of a layer formed on a semiconductor wafer by engaging said surface against a polishing pad disposed on a linearly moving belt in which said belt is disposed between a support platen and said wafer, comprising the steps of:

providing a dampening ring disposed to circumscribe said platen for reducing belt or pad fluctuation where said pad engages said wafer;

polishing said layer by linearly moving said belt and pad across said surface of said layer.

25. The method of claim 24 wherein said dampening ring is disposed at a height within an approximate range of 0.1 inch above and 0.1 inch below a height of said platen upon which said belt engages.

26. The method of claim 25 wherein said dampening ring is approximately 0.25 to 2.5 inches wide.

27. The method of claim 24 further including a step of providing a wafer retainer ring circumscribing said wafer and having sufficient width to further dampen said fluctuations where said pad engages said wafer.

28. The method of claim 27 wherein said width of said wafer retaining ring is approximately from 0.5 inches to a width of said dampening ring.

* * * * *

UNITED STATES PATENT AND TRADEMARK OFFICE

CERTIFICATE OF CORRECTION

PATENT NO. : 5,722,877

DATED : March 3, 1998

INVENTOR(S) : Meyer et al.

It is certified that error appears in the above-identified patent and that said Letters Patent is hereby corrected as shown below:

In the Drawings:

Figure 11, "16" should be --16a--.

Column 2, Line 29, "to be" should be --are--.

Column 2, Line 31, after "is" insert --improved--.

Column 7, Line 4, delete "more".

Claim 10, Column 10, Line 7, "engages" should be --engage--.

Signed and Sealed this

Thirtieth Day of June, 1998

*Attest:*

*Attesting Officer*

Bruce Lehman

BRUCE LEHMAN

*Commissioner of Patents and Trademarks*